US011572250B2

(12) United States Patent
Montes

(10) Patent No.: US 11,572,250 B2
(45) Date of Patent: Feb. 7, 2023

(54) HOSE COILING DEVICE

(71) Applicant: Anthony Montes, Willow Street, PA (US)

(72) Inventor: Anthony Montes, Willow Street, PA (US)

( * ) Notice: Subject to any disclaimer, the term of this patent is extended or adjusted under 35 U.S.C. 154(b) by 169 days.

(21) Appl. No.: 17/210,735

(22) Filed: Mar. 24, 2021

(65) Prior Publication Data

US 2021/0300720 A1 Sep. 30, 2021

Related U.S. Application Data

(60) Provisional application No. 63/000,733, filed on Mar. 27, 2020.

(51) Int. Cl.
*B65H 75/08* (2006.01)
*B65H 75/44* (2006.01)

(52) U.S. Cl.
CPC ..... *B65H 75/4492* (2013.01); *B65H 75/08* (2013.01)

(58) Field of Classification Search
CPC .. B65H 75/08; B65H 75/406; B65H 75/4492; B65H 54/585; B65H 2701/33; B65H 2701/332
See application file for complete search history.

(56) References Cited

U.S. PATENT DOCUMENTS

| | | | | |
|---|---|---|---|---|
| 5,188,307 | A | 2/1993 | Miller | |
| 6,241,175 | B1 | 6/2001 | Nichols | |
| 6,561,450 | B1 | 5/2003 | Walsh | |
| 9,156,650 | B2 * | 10/2015 | Conway | B65H 54/585 |
| 2007/0075177 | A1 | 4/2007 | Mehrer | |
| 2014/0374528 | A1 | 12/2014 | Conway | |

* cited by examiner

*Primary Examiner* — Sang K Kim
(74) *Attorney, Agent, or Firm* — Boudwin Intellectual Property; Daniel Boudwin

(57) ABSTRACT

A hose coiling device is provided. The hose coiling device includes an elongated shaft having an upper end and a lower end. An offset handle extends from the elongated shaft. A grip is affixed to the upper end, and a connector is disposed on the lower end. The connector removably secures one of a plurality of interchangeable tool heads thereto, wherein the plurality of interchangeable tool heads includes at least a flat hose coiling tool head and a garden hose coiling tool head. The flat hose coiling tool head includes a base removably securable to the connector, wherein the base includes a first prong and a second prong extending therefrom. The first prong is disposed parallel to the second prong. The garden hose coiling tool head includes a U-shaped member removably securable to the connector having at least one platform extending perpendicularly inwardly from an arm of the U-shaped member.

15 Claims, 5 Drawing Sheets

HOSE COILING DEVICE

CROSS REFERENCE TO RELATED APPLICATIONS

This application claims the benefit of U.S. Provisional Application No. 63/000,733 filed on Mar. 27, 2020. The above identified patent application is herein incorporated by reference in its entirety to provide continuity of disclosure.

BACKGROUND OF THE INVENTION

The present invention relates to hose coiling devices. More particularly, the present invention pertains to a hose coiling tool having a plurality of interchangeable heads to facilitate coiling of a variety of hoses, cables, or the like.

Many individuals, such as groundskeepers, firefighters, and the like utilize hoses on a regular basis. Proper hose storage can help prevent damage to the hose and increase storage efficiency. Typically, hoses are stored in a coiled state, such that the hose is consolidated within a relatively small area, however, manually coiling a hose can be time -consuming and frustrating to complete. For especially large hoses, such as the flat laying hoses used in firefighting, multiple people may be required to properly coil a hose for storage. Other hose coiling devices are particular to a certain style of hose, which can result in the user requiring multiple tools to accomplish the same task. Additionally, in order to ensure the coiled hose is relatively flat, users require a level surface, such as the ground. Using the ground to coil hoses often requires users to bend or kneel, which can be difficult or painful for those with limited mobility. Therefore, a device that allows a user to coil a variety of hoses easily and efficiently from a standing position is desired.

In light of the devices disclosed in the known art, it is submitted that the present invention substantially diverges in design elements from the known art and consequently it is clear that there is a need in the art for an improvement to existing hose coiling devices. In this regard, the instant invention substantially fulfills these needs.

SUMMARY OF THE INVENTION

In view of the foregoing disadvantages inherent in the known types of hose coiling devices now present in the known art, the present invention provides a hose coiling device having interchangeable tool heads wherein the same can be utilized for providing convenience for the user when coiling a variety of hose types.

The present system comprises an elongated shaft having an upper end opposite a lower end. An offset handle extends from the elongated shaft. A grip is affixed to the upper end and a connector is disposed on the lower end. The connector is configured to removably secure one of a plurality of interchangeable tool heads thereto, wherein the plurality of interchangeable tool heads comprises at least a flat hose coiling tool head and a garden hose coiling tool head. The flat hose coiling tool head comprises a base removably securable to the connector, wherein the base includes a first prong and a second prong extending therefrom. The first prong is disposed parallel to the second prong. The garden hose coiling tool head comprises a U-shaped member removably securable to the connector, the U-shaped member having at least one platform extending perpendicularly inwardly from an arm of the U-shaped member.

In some embodiments, the first prong comprises a length greater than a length of the second prong. In another embodiment the first prong tapers to a point at a distal end thereof. In other embodiments, a linear distance between the first prong and the second prong is less than a diameter of a flat hose head. In yet another embodiment, a brace extends between the second prong and an upper end of the base. In some embodiments, the grip comprises a hemispherical head. In another embodiment, the first prong is coaxial with the elongated shaft when the flat hose coiling tool head is removably secured thereto. In other embodiments, the offset handle comprises an upper leg and a lower leg extending from the elongated shaft, wherein the upper leg and the lower leg are connected via a central leg parallel to a longitudinal axis of the elongated shaft. In yet another embodiment, the offset handle is integral with the elongated shaft. In some embodiments, an ergonomic grip is disposed along the central leg. In another embodiment, the plurality of interchangeable tool heads further comprises an auger tool head removably securable to the connector, the auger tool head comprising a central shaft having a blade helically affixed about the central shaft. In other embodiments, the central shaft tapers to a point at a far end thereof. In yet another embodiment, the connector comprises a pin-detent mechanism configured to fractionally engage each of the plurality of interchangeable tool heads through an aperture disposed through each of the interchangeable tool heads. In some embodiments, the elongated shaft, the offset handle, and the connector comprise a unitary structure. In another embodiment, the grip is rotatably affixed to the elongated shaft, such that the grip rotates about a longitudinal axis of the elongated shaft.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
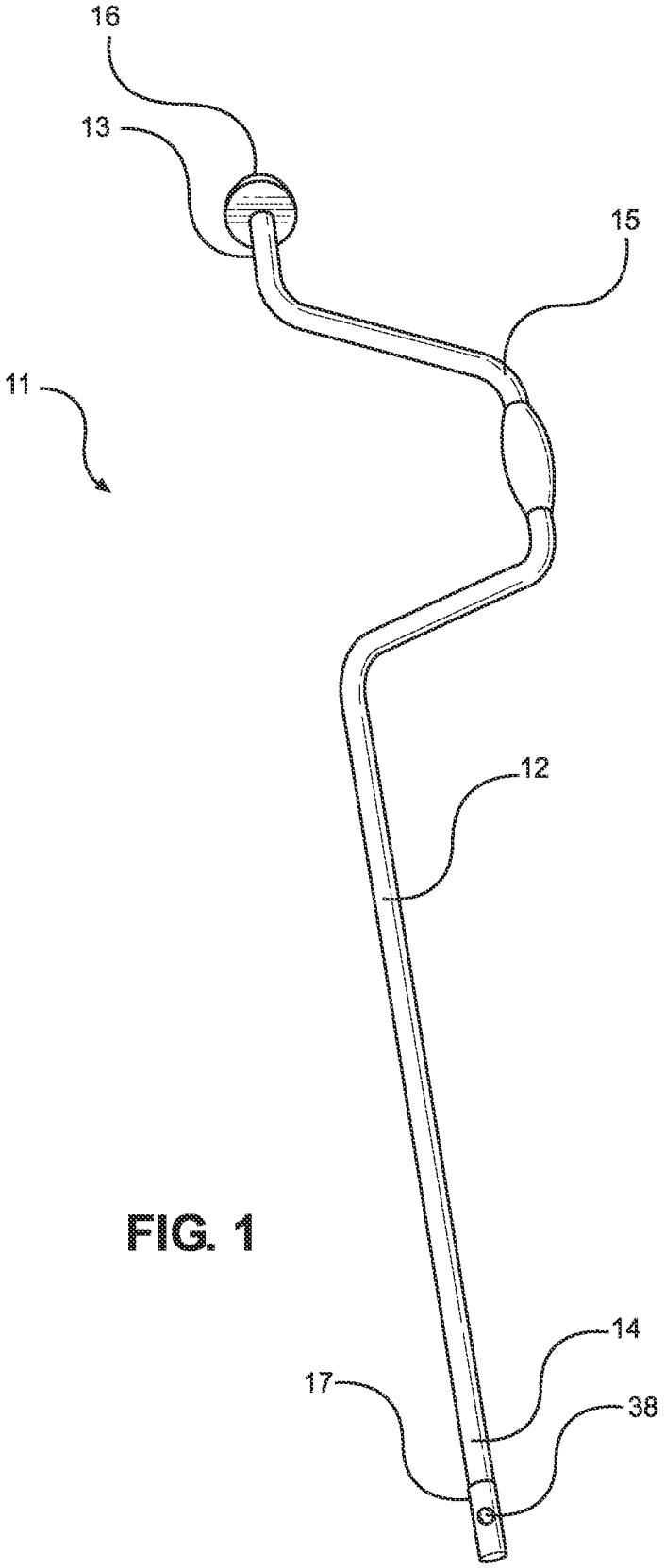
FIG. 1 shows a perspective view of the elongated shaft of an embodiment of the hose coiling device.

Reference is made herein to the attached drawings. Like reference numerals are used throughout the drawings to depict like or similar elements of the hose coiling tool. The figures are intended for representative purposes only and should not be considered to be limiting in any respect.

Referring now to FIG. 1, there is shown a perspective view of the elongated shaft of an embodiment of the hose coiling device. The hose coiling device 11 comprises an elongated shaft 12 having an upper end 13 opposite a lower end 14. An offset handle 15 extends from the elongated shaft 12, such that the offset handle 15 is disposed along an axis distinct from a longitudinal axis of the elongated shaft 12. A linear distance between the elongated shaft 12 and the offset handle 15 is further dimensioned to facilitate rotation of the elongated shaft 12 about a longitudinal axis thereof, such that the linear distance does not exceed the average reach of a user's arm. In this manner, the user can retain the elongated shaft 12 in a desired position with a first hand while grasping and rotating the offset handle 15 about the longitudinal axis of the elongated shaft 12 with a second hand. The elongated shaft 12 and offset handle 15 are contemplated to comprise a unitary and monolithic construction in some embodiments, so as to increase structural integrity of the hose coiling device 11. A grip 16 is disposed on the upper end 13. In the illustrated embodiment, the grip 16 comprises a hemispherical form factor configured to provide a comfortable gripping surface for a user's palm.

Figure 3:
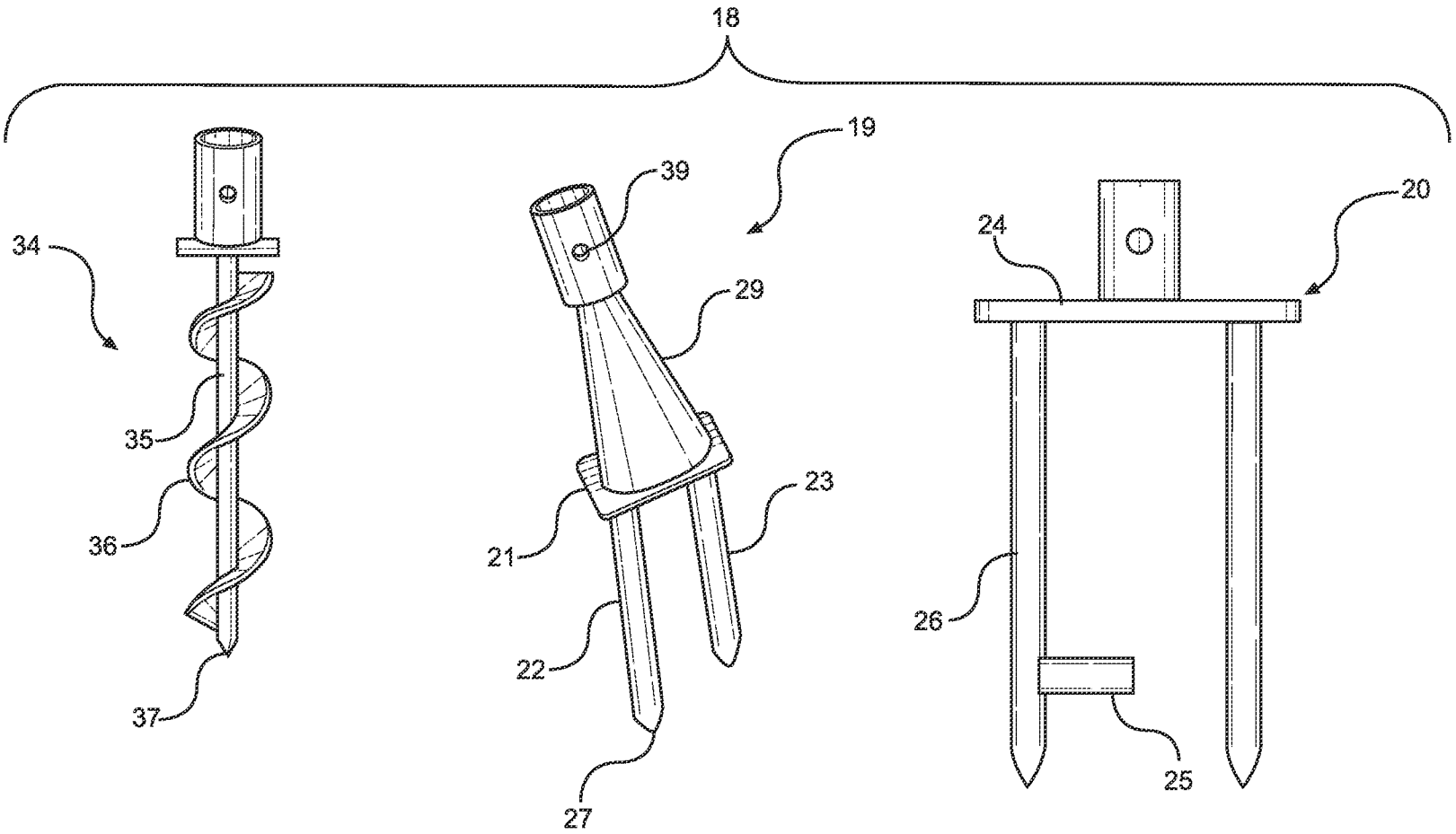
FIG. 3 shows a perspective view of the plurality of interchangeable tool heads of an embodiment of the hose coiling device.

A connector 17 is disposed on the lower end 14 of the elongated shaft 12, wherein the connector 17 is configured to removably secure one of a plurality of interchangeable tool heads (as shown in FIG. 3, 18) thereto. In some embodiments, each tool head of the plurality of interchangeable tool heads frictionally engages the connector 17, such that the tool head is retained thereon. In alternate embodiments, the connector 17 comprises a threaded external surface configured to engage complementary internal threading disposed on an interior surface of each tool head.

Figure 2:
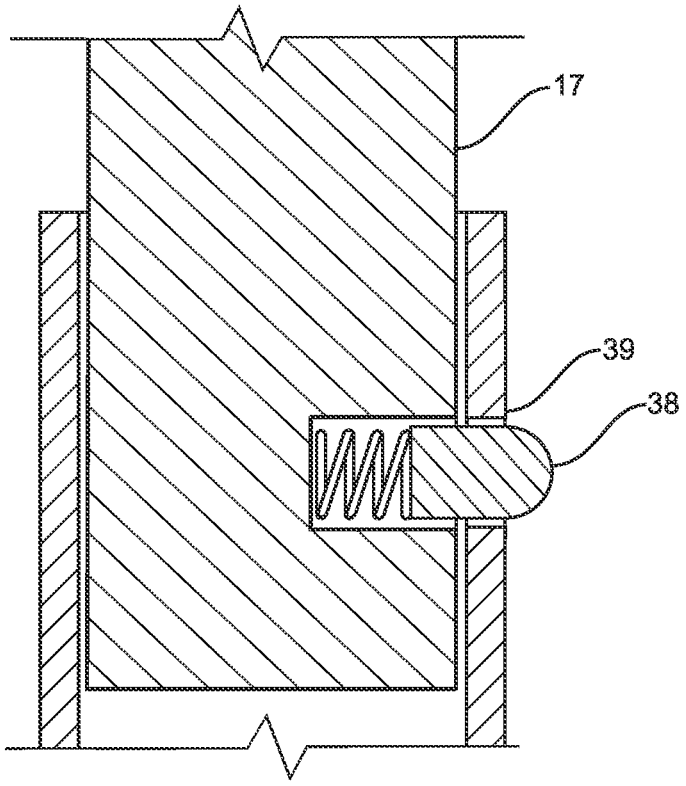
FIG. 2 shows a cross-sectional view of the connector of an embodiment of the hose coiling device.

Referring now to FIG. 2, there is shown a cross-sectional view of the connector of an embodiment of the hose coiling tool. In the shown embodiment, the connector 17 further comprises a pin-detent mechanism 38 disposed within the connector 17, wherein the pin-detent mechanism 38 is configured to selectively move between extended position and a retracted position, wherein the retracted position, the pin-detent mechanism 38 is disposed within the connector 17. In such embodiments, the pin-detent mechanism 38 is spring biased towards the extended position. In this manner, an interchangeable tool head can be placed over the connector 17 and secured thereto via the pin-detent mechanism 38 engaging an aperture 39 disposed through each tool head. In some embodiments, the connector 17 comprises a square cross-sectional configuration, such that torque applied to the interchangeable tool head via rotation of the elongated shaft during operation is evenly distributed across the connector 17. In this manner, pressure applied to the pin-detent mechanism 38 during operation is reduced to minimize the risk failure of the pin-detent mechanism 38.

Referring now to FIG. 3, there is shown a perspective view of the plurality of interchangeable tool heads of an embodiment of the hose coiling device. In the illustrated embodiment, each of the plurality of interchangeable tool heads 18 each comprise a socket on an upper portion thereof, wherein the socket is configured to removably secure to the connector. In some embodiments, the socket is dimensioned to frictionally engage about the connector within a close tolerance, such that each interchangeable tool head 18 is retained on the connector. In the illustrated embodiment, each socket further comprises an aperture 39 therethrough, wherein the aperture 39 is configured to receive the pin-detent mechanism of the connector therethrough when in the extended position, thereby retaining the interchangeable tool head 18 thereon. In yet another embodiment, threading is disposed on an interior surface of the socket, wherein the threading engages complementary threading on the exterior surface of the connector. In this manner, the user can selectively affix and detach each of the plurality of interchangeable tool heads 18 to the elongated shaft to suit the current needs of the user.

Figure 4:
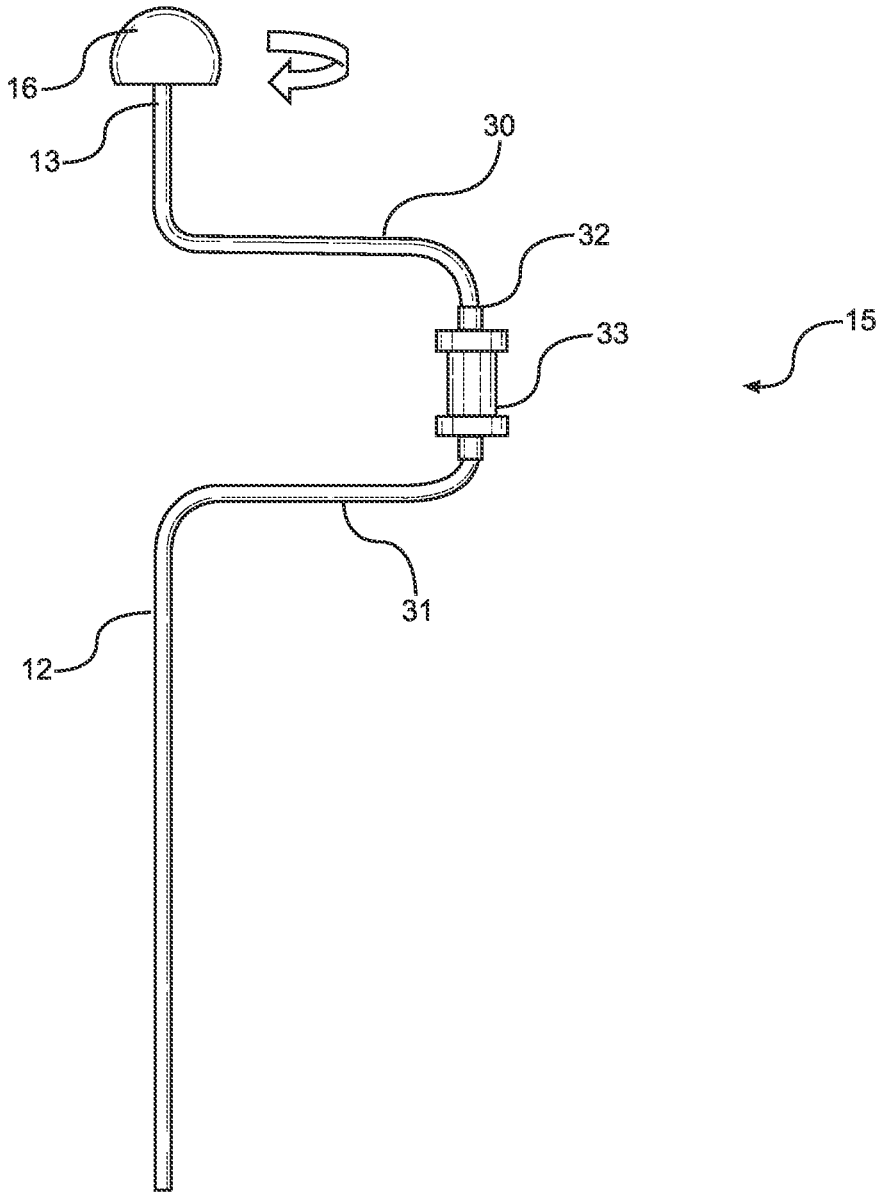
FIG. 4 shows a close-up view of the offset handle of an embodiment of the hose coiling device.

One of the plurality of interchangeable tool heads 18 comprises a flat hose tool head 19, wherein the flat hose tool head 19 comprises a base 21 having a first prong 22 and a second prong 23 extending therefrom. The first, and second prongs 22, 23 are disposed parallel to each other. The socket is disposed on the base 21 opposite the first and second prongs 22, 23. In the illustrated embodiment, the first prong 22 comprises a length greater than the second prong 23, such that the second prong 23 is retained in an elevated position above a ground surface when in use. Furthermore, in the shown embodiment, the first prong 22 is disposed coaxially with the socket, such that the first prong 22 is aligned with the longitudinal axis of the elongated shaft when affixed to the connector. In this manner, the hose coiling tool is in contact with the ground surface along a single point of contact aligned with the longitudinal axis, thereby facilitating rotation about, the first prong 22. In the shown embodiment, a linear distance between the first and second prongs 22, 23 comprises a distance less than that of a flat hose head (as shown in FIG. 4, 28). In this manner, the hose can be retained between the first and second prongs 22, 23 when in use. In the illustrated embodiment, a distal end 27 of the first prong 22 tapers to a point to further reduce the surface area in contact with the ground surface such that the user can readily rotate the hose coiling tool. Additionally, in the shown embodiment, the flat hose tool head 19 comprises a brace 29 disposed on the base 21, wherein the brace 29 extends between the second prong 23 and the socket. In this manner, the brace 29 provides additional structural support to the flat hose tool head 19.

The plurality of interchangeable tool heads 18 further comprises a garden hose tool head 20 configured to engage and retain a substantially cylindrical hose, such as a garden hose thereon. In the illustrated embodiment, the garden hose tool head 20 comprises a U-shaped member 24 having a pair of arms 26, wherein the pair of arms 26 are parallel to each other and extend perpendicularly from an upper end of the U-shaped member 24. A platform 25 extends from one of the pair of arms 26, wherein the platform 25 is configured to maintain a cylindrical hose thereon. In some embodiments, a lip is disposed on an end of the platform 25, such to further retain the hose on the platform 25. In other embodiments, the platform 25 may comprise a pair of platforms 25 to increase surface area in contact with the cylindrical hose to aid in frictional engagement. In the shown embodiment, a distance between the end of the platform 25 and the opposing arm of the pair of arms 26 is dimensioned to be greater than a width of a standard cylindrical garden hose to allow a user to insert the garden hose into the U-shaped member to be retained on the platform 25. The platform 25 supports the cylindrical hose or cable above the ground surface to prevent the hose from rolling about the surface during a typical coiling process to ensure that the hose or cable is properly coiled.

In the shown embodiment, one of the plurality of interchangeable tool heads 18 comprises an auger tool head 34. The auger tool head 34 comprises a central shaft 35 coaxially aligned with the socket, wherein the central shaft 35 further comprises a blade 36 helically wrapped about the central shaft 35. The blade 36 may include a sharpened exterior edge to facilitate displacement of a ground surface for digging a hole within the ground surface. In the shown embodiment, a far end 37 of the central shaft 35 tapers to a point such that the central shaft 35 can engage within a ground surface to stabilize the auger tool head 34 during operation. In this manner, the user can ensure that the blade 36 displaces earth in a desired area without shifting along the ground surface during use.

Referring now to FIG. 4, there is shown a close-up view of the offset handle of an embodiment of the hose coiling device. In the illustrated embodiment, the offset handle 15 comprises an upper leg 30 and a lower leg 31 extending substantially perpendicularly from the elongated shaft 12. A central leg 32 is disposed between and unitary with the upper and lower legs 30, 31 such that the central leg 32 is parallel to a longitudinal axis of the elongated shaft 12. In this manner, the offset handle 15 can be rotated about the longitudinal axis of the elongated shaft 12 to rotate an affixed tool head. In the shown embodiment, an ergonomic grip 33 is disposed on the central leg 32, wherein the ergonomic grip 33 is configured to provide a comfortable gripping surface for a user during operation of the hose coiling tool. In the illustrated embodiment, the ergonomic grip 33 comprises a cylindrical cushioned grip having retaining flanges on an upper and lower end thereof. In this manner, the user's hand can be retained on the ergonomic grip 33 during use. In other embodiments, such as the embodiment of FIG. 1, the ergonomic grip 33 comprises a wider central portion tapering towards each of the upper and lower ends of the ergonomic grip 33 to conform to a user's hand. In the illustrated embodiment, the grip 16 is rotationally affixed to the upper end 13 of the elongated shaft 12, wherein the grip 16 is configured to rotate about a longitudinal axis of the elongated shaft 12. In this manner, the user can grasp the grip 16 in a substantially open hand to stabilize the elongated shaft 12 during operation, while the offset handle 15 is rotated. As the offset handle 15 is rotated, the user need not reposition the hand grasping the grip 16, thereby allowing the user to apply consistent and even pressure towards the lower end of the elongated shaft 12, such that the tool head properly engages a ground surface during use.

Figure 5:
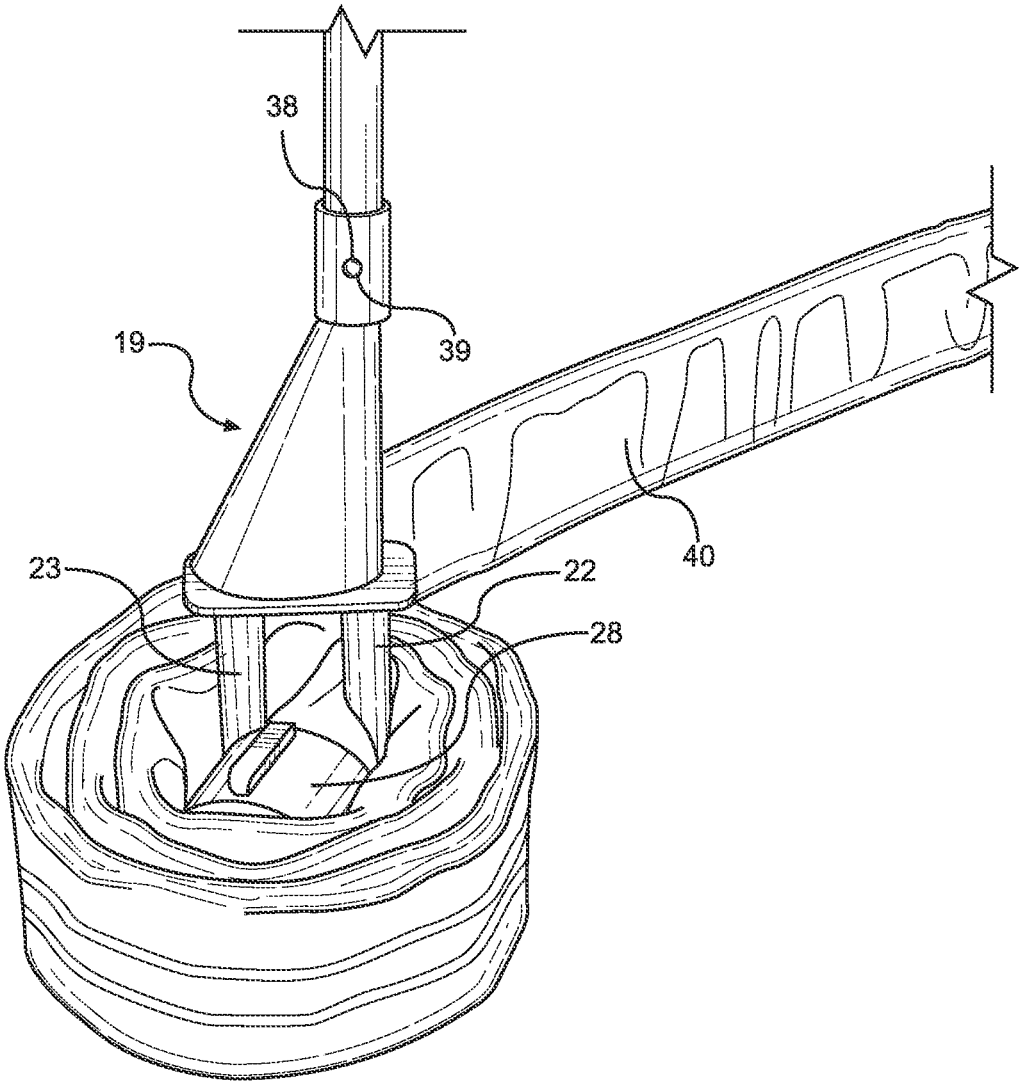
FIG. 5 shows a perspective view of an embodiment of the hose coiling device in use.

Referring now to FIG. 5, there is shown a perspective view of an embodiment of the hose coiling device in use. In one use, the user can secure one of the plurality of interchangeable tool heads to the connector disposed on the lower end of the elongated shaft. In the shown embodiment, the user can secure the tool head to the connector via depressing the pin-detent mechanism 38 and inserting the connector into the socket of the tool head to engage the pin-detent mechanism through the aperture 39 disposed through the socket. In the shown embodiment, the flat hose tool head 19 is affixed to the hose coiling tool for use with a flat hose 40, such as typically used in firefighting. The first and second prongs 22, 23 can be placed on opposite sides of the flat hose 40 adjacent the flat hose head 28. The flat hose head 28 comprises a diameter greater than a linear distance between the first and second prongs 22, 23 such that the flat hose 40 is retained within the flat hose tool head 19 during operation. As the first prong 22 comprises a greater length than the second prong 23, the first prong 22 is a single point of contact with the ground surface. The user can then grasp the grip and exert downward pressure on the elongated shaft while rotating the offset handle to rotate the flat hose tool head 19 about the longitudinal axis of the elongated shaft. This results in the flat hose 40 coiling against the ground surface to ensure that the flat hose 40 is coiled into a tight disc to minimize storage space required. Once the flat hose 40 is properly coiled, the elongated shaft and the affixed flat hose tool head 19 can then be raised to disengage the flat hose tool head 19 from the flat hose 40. Similarly, alternate interchangeable tool heads can be utilized to aid in performing other tasks, such as coiling cables and cylindrical garden hoses or digging a hole in a ground surface. In such uses, the principal operation is substantially similar, however the cable or garden hose is instead placed upon the platform of the garden hose tool head to prevent the garden hose from rolling about the ground surface during the coiling process.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hose coiling device, comprising:

an elongated shaft having an upper end opposite a lower end;

an offset handle extending from the elongated shaft;

a grip affixed to the upper end;

a connector disposed on the lower end;

wherein the connector removably secures one of a plurality of interchangeable tool heads thereto;

wherein the plurality of interchangeable tool heads includes at least a flat hose coiling tool head and a garden hose coiling tool head;

wherein the flat hose coiling tool head comprises a base removably securable to the connector, the base having a first, prong and a second prong extending therefrom;

wherein the first prong is disposed parallel to the second prong;

wherein the garden hose coiling tool head comprises a U-shaped member removably securable to the connector, the U-shaped member having at least one platform extending perpendicularly inwardly from an arm of the U-shaped member.

2. The hose coiling device of claim 1, wherein the first prong comprises a length greater than a length of the second prong.

3. The hose coiling device of claim 1, wherein the first prong tapers to a point at a distal end thereof.

4. The hose coiling device of claim 1, wherein a linear distance between the first prong and the second prong is less than a diameter of a flat hose head.

5. The hose coiling device of claim 1, further comprising a brace extending between the second prong and an upper end of the base.

6. The hose coiling device of claim 1, wherein the grip comprises a hemispherical head.

7. The hose coiling device of claim 1, wherein the first prong is coaxial with the elongated shaft when the flat hose coiling tool head is removably secured thereto.

8. The hose coiling device of claim 1, wherein the offset handle comprises an upper leg and a lower leg extending from the elongated shaft, wherein the upper leg and the lower leg are connected via a central leg parallel to a longitudinal axis of the elongated shaft.

9. The hose coiling device of claim 8, wherein the offset handle is integral with the elongated shaft.

10. The hose coiling device of claim 8, further comprising an ergonomic grip disposed along the central leg.

11. The hose coiling device of claim 1, wherein the plurality of interchangeable tool heads further comprises an auger tool head removably securable to the connector, the auger head comprising a central shaft having a blade helically affixed about the central shaft.

12. The hose coiling device of claim 11, wherein the central shaft tapers to a point at a far end thereof.

13. The hose coiling device of claim 1, wherein the connector comprises a pin-detent mechanism configured to frictionally engage each of the plurality of interchangeable tool heads through an aperture disposed through each of the interchangeable tool heads.

14. The hose coiling device of claim 1, wherein the elongated shaft, the offset handle, and the connector comprise a unitary structure.

15. The hose coiling device of claim 1, wherein the grip is rotatably affixed to the elongated shaft, such that the grip rotates about a longitudinal axis of the elongated shaft.

* * * * *